US006416329B1

(12) United States Patent
Hirota et al.

(10) Patent No.: US 6,416,329 B1
(45) Date of Patent: Jul. 9, 2002

(54) WRITING DEVICE FOR PRACTICE IN WRITING CHARACTERS

(75) Inventors: Kashichi Hirota, Hachioji; Makoto Kaneda, Saitama-ken, both of (JP)

(73) Assignee: Kyowa Electric and Chemical Co., Ltd., Tokyo (JP)

( * ) Notice: Subject to any disclaimer, the term of this patent is extended or adjusted under 35 U.S.C. 154(b) by 7 days.

(21) Appl. No.: 09/634,500

(22) Filed: Aug. 8, 2000

(30) Foreign Application Priority Data

Aug. 13, 1999 (JP) ..... 11-229332

(51) Int. Cl.[7] ..... B43L 1/00

(52) U.S. Cl. ..... 434/409; 40/621; 434/408; 434/159

(58) Field of Search ..... 446/129; 434/168, 434/172, 190, 301, 309, 330, 409, 410, 162; D19/52

(56) References Cited

U.S. PATENT DOCUMENTS

| | | | | | |
|---|---|---|---|---|---|
| 181,653 | A | * | 8/1876 | Du Brul | 434/159 |
| 3,509,644 | A | * | 5/1970 | Santell | 40/621 |
| 4,143,472 | A | * | 3/1979 | Murata et al. | 35/66 |
| 4,188,734 | A | * | 2/1980 | Rich | 35/35 H |
| 4,605,328 | A | * | 8/1986 | Shomura et al. | 400/662 |
| 4,931,019 | A | * | 6/1990 | Park | 434/409 |
| 4,960,382 | A | * | 10/1990 | Alford | 434/164 |
| D321,865 | S | * | 11/1991 | Derocher | D14/100 |
| 5,295,837 | A | * | 3/1994 | Gilano et al. | 434/409 |
| 5,324,202 | A | * | 6/1994 | Meyers et al. | 434/410 |
| 5,788,506 | A | * | 8/1998 | Chabay | 434/301 |
| 5,820,385 | A | * | 10/1998 | Ohashi et al. | 434/409 |
| 6,196,848 | B1 | * | 3/2001 | Yamazaki | 434/409 |
| 6,201,947 | B1 | * | 3/2001 | Hur et al. | 434/317 |

FOREIGN PATENT DOCUMENTS

| | | |
|---|---|---|
| JP | 7-181905 | 7/1995 |
| JP | 7-323149 | 12/1995 |
| JP | 10-91105 | 4/1998 |
| JP | 11-81877 | 3/1999 |

* cited by examiner

*Primary Examiner*—Derris H. Banks
*Assistant Examiner*—Dmitry Suhol
(74) *Attorney, Agent, or Firm*—Jacobson Holman, PLLC

(57) ABSTRACT

In a magnetically writable and erasable writing device for practice in writing characters, the writing device includes a case member provided with an opening in a top surface of the case member wherein a frame section surrounding the opening is formed on the top surface of the case member. A writing sheet includes a microcapsule magnetic sheet and is disposed on the case member so as to expose a top face of the writing sheet from the opening of the case member. A magnetic member for writing on the writing sheet and an erasing member which is positioned under the writing sheet and which has magnetism is included in the case member. The magnetic member put on the top face of the writing sheet enables writing and moving the erasing member along a back face of the writing sheet enables the written contents to be erased. The frame section of the top surface of the case member indicates a character model.

6 Claims, 9 Drawing Sheets

WRITING DEVICE FOR PRACTICE IN WRITING CHARACTERS

FIELD OF THE INVENTION

The present invention relates to a writing device for practice in writing characters with reference to a character model.

BACKGROUND OF THE INVENTION

Young children usually obtain practice in writing characters by repeatedly writing characters on a paper with a pen or pencil with reference to a character model. Particularly in initial stage, the practice is enjoyably performed by easily depicting a character model on a paper with ink stamps respectively having a mark of a character model, or by using a character drill book in which a character model is represented by a dotted line and tracing the character model with a pen or pencil.

Meanwhile, there is known a magnetically writable and erasable writing device. In this device, a microcapsule magnetic sheet is used as a writing sheet so that characters and figures can be freely written on the writing sheet with a magnetic pen having an end made of magnetic material, and the characters and figures written on the top face of the writing sheet can also be erased with an erasing member which has magnetism and is disposed on a back face of the writing sheet.

The theory of the above device will be shortly described as follows. As shown in FIG. 1, in a microcapsule magnetic sheet 10 for use in a writing sheet, microcapsules 11 respectively having about the size of 500 $\mu$m in diameter are two-dimensionally arranged between a top sheet 12 and a back sheet 13. A black magnetic powder 14 having magnetism and a white emulsion 15 are enclosed in each microcapsule 11. Thus, when magnets 16, 17 are positioned close to the microcapsule magnet sheet 10, the black magnetic powder 14 in the microcapsule 11 is magnetically attracted so as to present a black color on one side of the microcapsule magnet sheet 10 to which the magnets 16, 17 are closely positioned. In contrast, on the other side of the microcapsule magnet sheet 10, a white color can be presented due to presence of only the white emulsion 15. Applying this theory of magneticphoresis to the magnetically writable and erasable writing device enables black color characters or figures to be freely written on the front sheet 12 with the magnet 16. In addition, when the magnet 17 is positioned close to and moved along the back sheet 13 of the microcapsule magnetic sheet 10, the magnetic powder 14 in the microcapsule 11 is attracted along the track of the magnet 17 toward the back sheet 13, so that the written characters or figures on the front sheet 12 can be erased.

The magnetically writable and erasable writing device is realized by using this theory. An inner mechanism of the device will be shortly described by taking "Recording Device Using Microcapsule Magnetic Sheet" described in Japanese Patent Application No. Hei 11-81877 filed by the present applicant as an example. As shown in FIG. 2, on the outside of a recording device 20, there are provided a case 21 which is of a rectangular, generally planar shape and formed in the upper section with a rectangular opening 22. There is also provided a writing sheet 23 comprised of a microcapsule magnetic sheet which is disposed on the case 21 so as to expose a top face of the microcapsule magnetic sheet through the upper opening 22 of the case 21. A magnetic pen 24 is provided and has a magnet on an end of the magnetic pen. The case 21 is provided with an erasing button 25 on the right lower side of the top surface of the case 21. As shown in FIG. 3, FIG. 4 and FIG. 5, within the recording device 20, there are provided an erasing sheet 26 which is positioned under and in parallel with the writing sheet 23 and which has magnetism, a motor 27, a battery 28, a switch 29, and a driving unit 30 which is connected to the erasing sheet 26 and which is powered by the motor 27. The driving unit 30 includes an eccentric cam mechanism 31 for creating a horizontally parallel movement of the erasing sheet 26, and an interlocking device for creating the movement in which the erasing sheet 26 is gotten close to or get away from the writing sheet 23 in conjunction with the horizontally parallel movement of the erasing sheet 26. The interlocking device comprised of a link mechanism 32 which couples the erasing sheet 26 to the case 21. The link mechanism 32 is swingable in the direction of the parallel movement of the erasing sheet 26. The driving unit 30 drives to reciprocate the erasing sheet 26 with keeping the erasing sheet approximately parallel to the writing sheet 23, from the position (FIG. 4) where the erasing sheet 26 is far enough from the writing sheet 23 so that the magnetic force of the erasing sheet 26 will not erase the written characters and figures on the writing sheet 23, to the position (FIG. 5) where the erasing sheet 26 is close enough to the writing sheet 23 so that the magnetic force of the erasing sheet 26 may erase the characters and figures on the writing sheet 23. When the erasing button 25 is pressed down, the switch 29 is turned on to start supplying an electric power from the batteries 28 to the motor 27, and the erasing sheet 26 is then started to move by the driving unit 30. The switch is kept in ON state until the eccentric cam 31 is gone into a 360-degree rotation by the erasing sheet 26 which is moving, and, that is, the erasing sheet 26 finishes one cycle of reciprocating motion. When the erasing sheet 26 finishes one cycle of reciprocating motion, the switch is turned off to automatically stop the motor 27, and one cycle of erasing motion is now completed. In other word, a learner can erase character or figures written on the writing sheet 23 in a lump simply by pressing the erasing button 25 on the top surface of the case 21.

When repeatedly writing characters on a paper with a pen or pencil with reference to a character model, or depicting a character model on a paper with ink stamps respectively having a mark of character model, or using a character drill book in which a character model is represented by a dotted line and tracing the character model with a pen or pencil, as described above, there are problems that it is required to appropriately supplement consumable supplies, such as a pen and pencil, a paper, a drill book in which a character model is represented by a dotted line, and an ink, and also surroundings, such as hands, a cloth, and a desk and wall, may be stained by the pencil or pen, and the ink of the ink stamp.

Thus, it may be appreciated to apply the aforementioned magnetically writable and erasable writing device, which enables to repeatedly writing any characters and figures and also enables to erase the written characters and figures without consuming writing tools, papers and the like, and without staining hands, clothes and the like, as a writing device for practice in writing characters.

However, heretofore in the practice in writing characters, there has been a problem that it has been necessary to prepare a referential character model in addition to the writing device and to place it in an appropriate position during the practice. Additionally, it has been necessary to store the referential character model not to be lost after the practice. This problem cannot be solved even if the magnetically writable and erasable writing device is applied. Besides, when the magnetically writable and erasable writing device is applied, the conventional ink stamps cannot jointly be used. Even assuming that the conventional ink stamps may be used, an extra space has been needed to store the ink stamps because they are bulky although a necessary stamping face is provided only on one side of each ink stamp, which would cause a problem. Further, when the magnetically writable and readable writing device is applied, if the a character model represented by dotted line similar to the conventional drill book is to be provided on the writing sheet of the writing device, the writing device should be fairly enlarged and otherwise the number of characters should be limited. This will cause another problem.

SUMMARY OF THE INVENTION

It is an object of the present invention to solve the aforementioned problems in applying the magnetically writable and readable writing device as a writing device for practice in writing characters, and to provide a writing device for practice in writing characters, in which no supplement of writing tools and the like is required, hands, clothes and the like being free from stain, the burden of preparing and handling of the character model being removed, no extra space being required, embarrass store keeping being removed, the character model being magnetically writable with extremely easy, the practice by tracing the dotted lines of the character model being able to be performed without enlarging the writing device and otherwise limiting the number of the characters.

In order to achieve the above object, according to the present invention, there is provided a writing device for practice in writing characters comprising: a case member provide with an opening in a top surface of the case member wherein a frame section surrounding the opening is formed on the top surface of the case member; a writing sheet which is comprised of a microcapsule magnetic sheet and which is disposed on the case member so as to expose a top face of the writing sheet from the opening of the case member; a magnetic member for writing on the writing sheet; and an erasing member which is positioned under the writing sheet and which has magnetism, wherein putting the magnetic member on the top face of the writing sheet enables writing, moving the erasing member along a back face of the writing sheet enabling the written contents to be erased, the frame section of the top surface of the case member indicating a character model. In one embodiment, a lid member covering all or part of the top surface of the case member may be pivotally attached to the case member wherein a spread surface of the lid member indicates the character model. In another embodiment, the character model may be a table of hiragana, katakana, alphabetical character, or a correspondence table of those.

In other embodiment, the magnetic member may comprise a non-magnetic gripping member, and a stamping face which includes a magnetic member indicating a mirror image of the character model on a surface of the gripping member, wherein putting the stamping face on the top face of the writing sheet enables a mark of the character model to be indicated on the top face of the writing sheet. In still other embodiment, the gripping member may be a polyhedron, and two or more side surfaces of the polyhedron may be provided for the stamping face. In yet other embodiment, the mark of the character model may be indicated by a solid line or dotted line thinner than a line written by the magnetic pen, or an outline which traces a periphery of the character model.

BRIEF DESCRIPTION OF THE DRAWINGS

FIG. 8(*b*) is a perspective view showing an upper surface of the first embodiment of the character model stamp according to the present invention.

DESCRIPTION OF THE PREFERRED EMBODIMENT

Preferred embodiments of the present invention will be described with reference to the drawings hereinafter.

Figure 1:
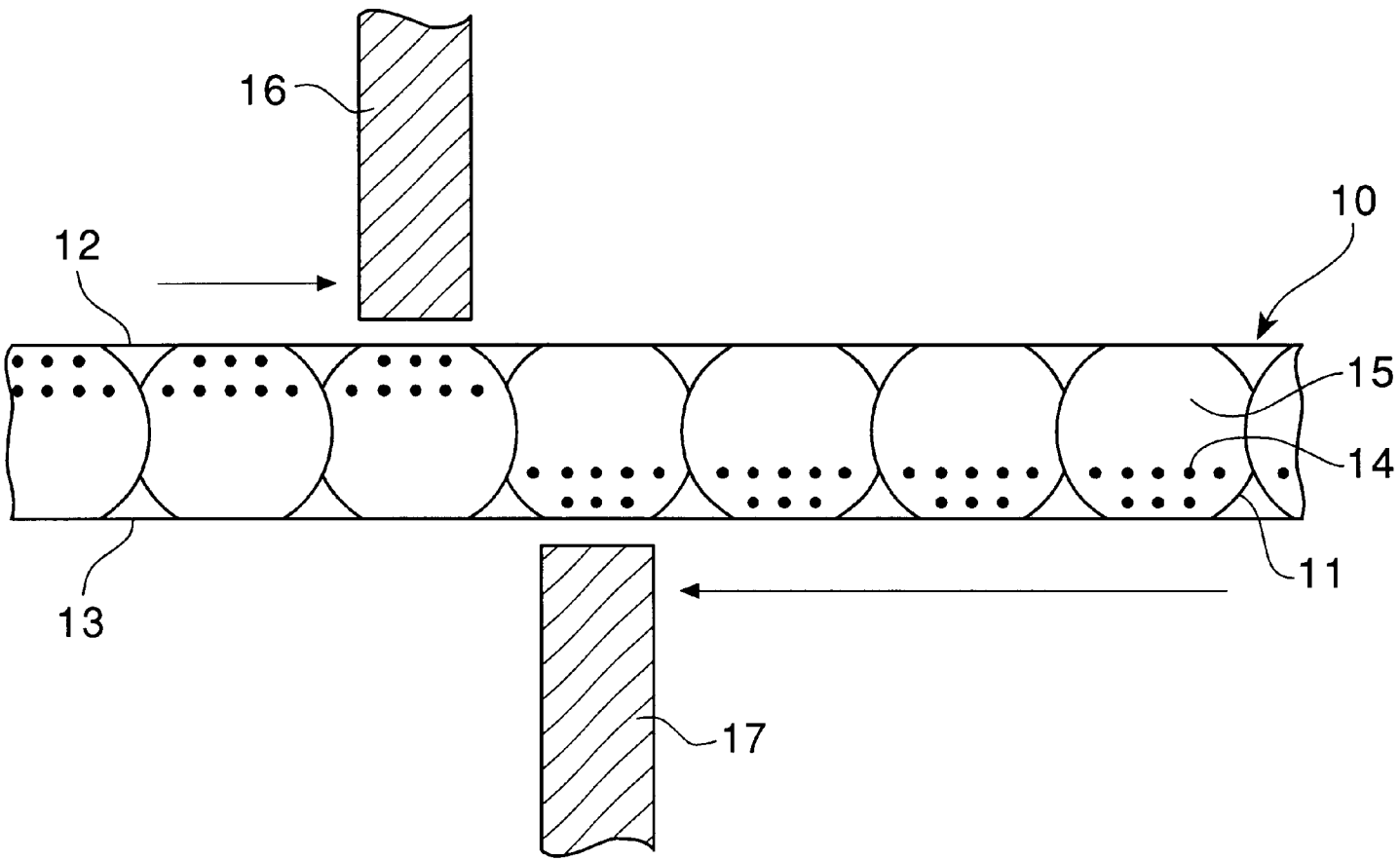
FIG. 1 (PRIOR ART)
FIG. 1 is a side view of a microcapsule magnetic sheet.
Figure 2:
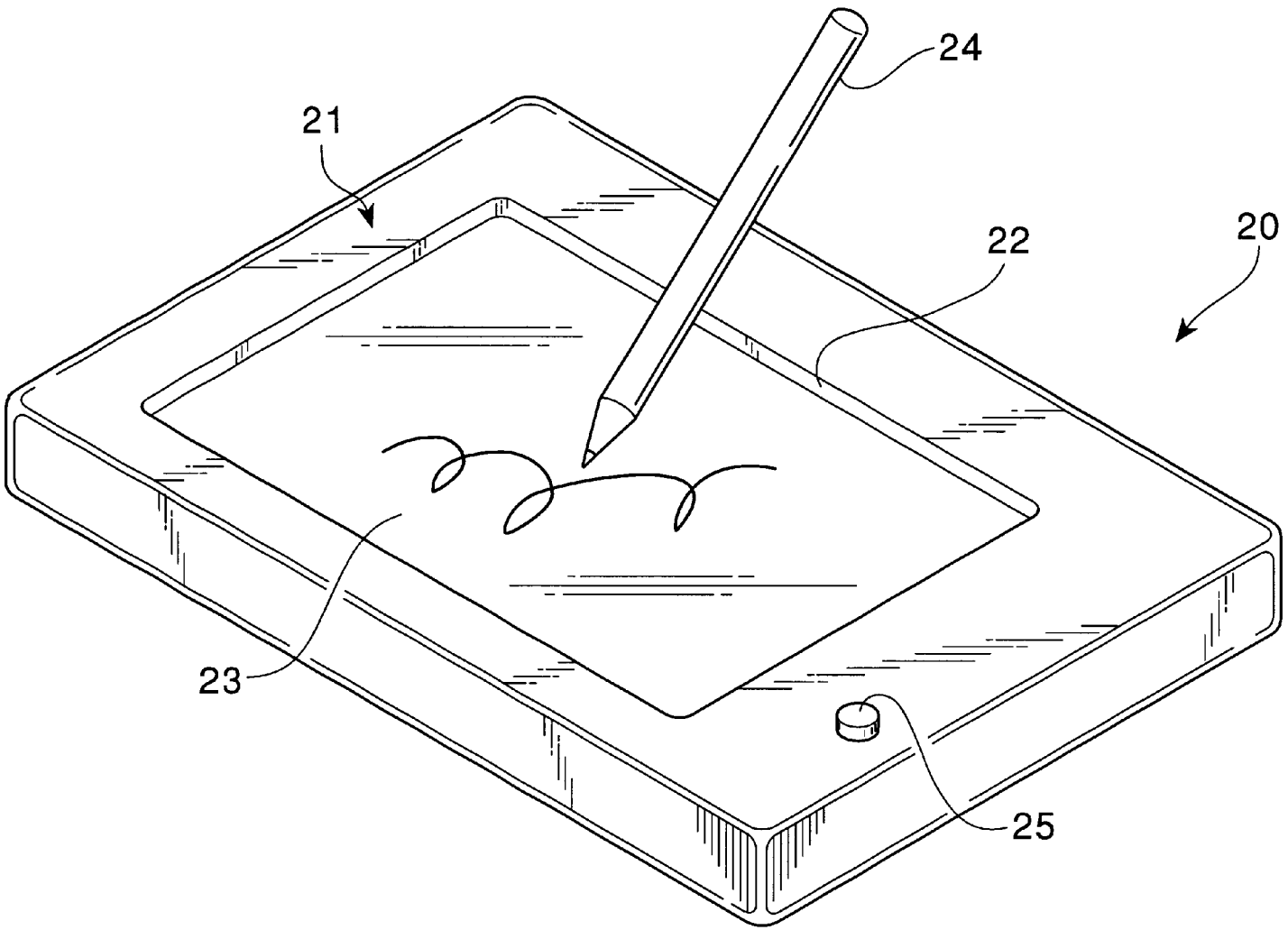
FIG. 2 is a perspective view showing an exterior of one embodiment of a recording sheet using a conventional microcapsule magnetic sheet.
Figure 3:
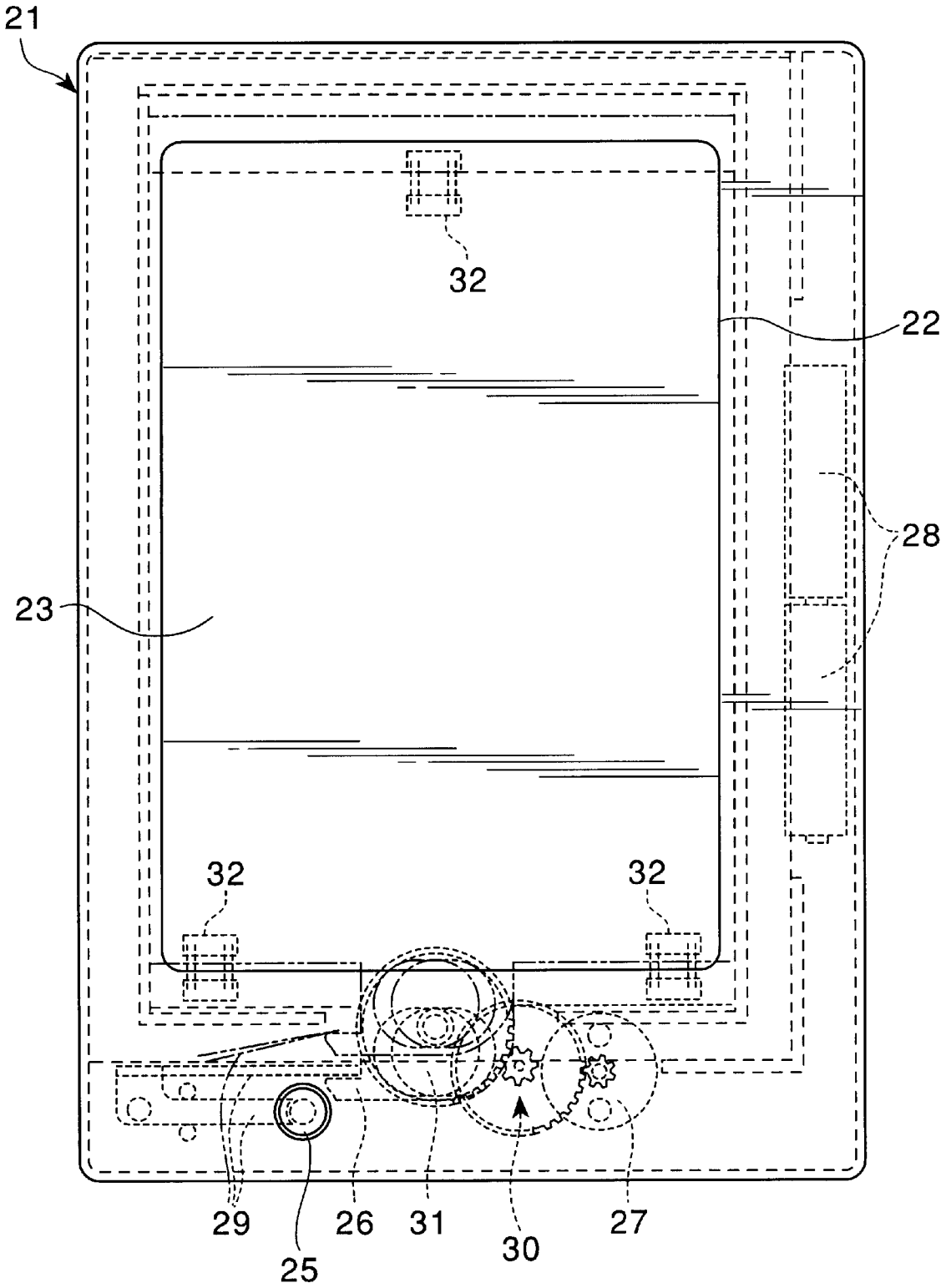
FIG. 3 is a top plan view showing an internal mechanism of the recording sheet shown in FIG. 2.
Figure 4:
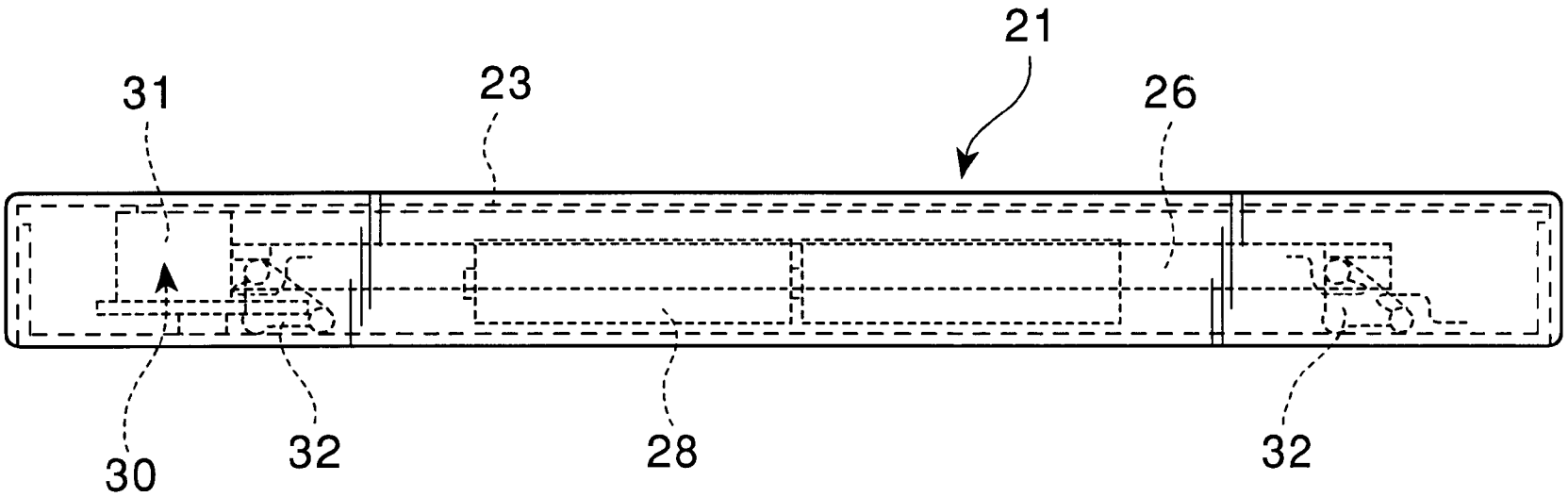
FIG. 4 is a side view showing an internal mechanism of the recording sheet shown in FIG. 2.
Figure 5:
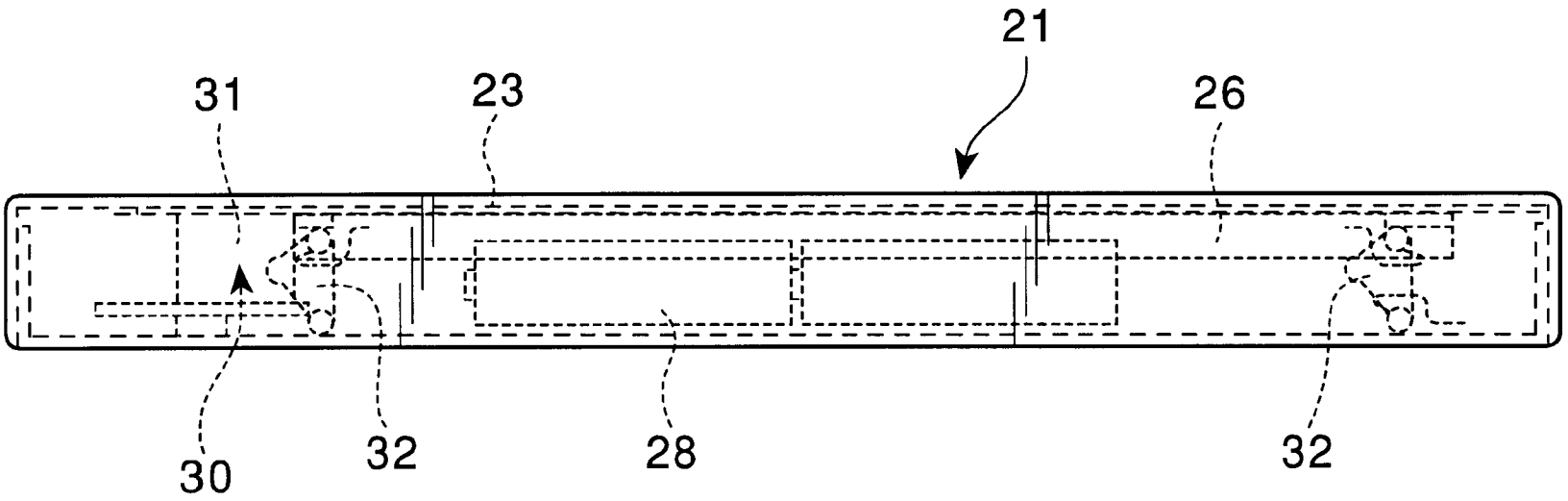
FIG. 5 is a side view showing an internal mechanism of the recording sheet shown in FIG. 2.
Figure 6:
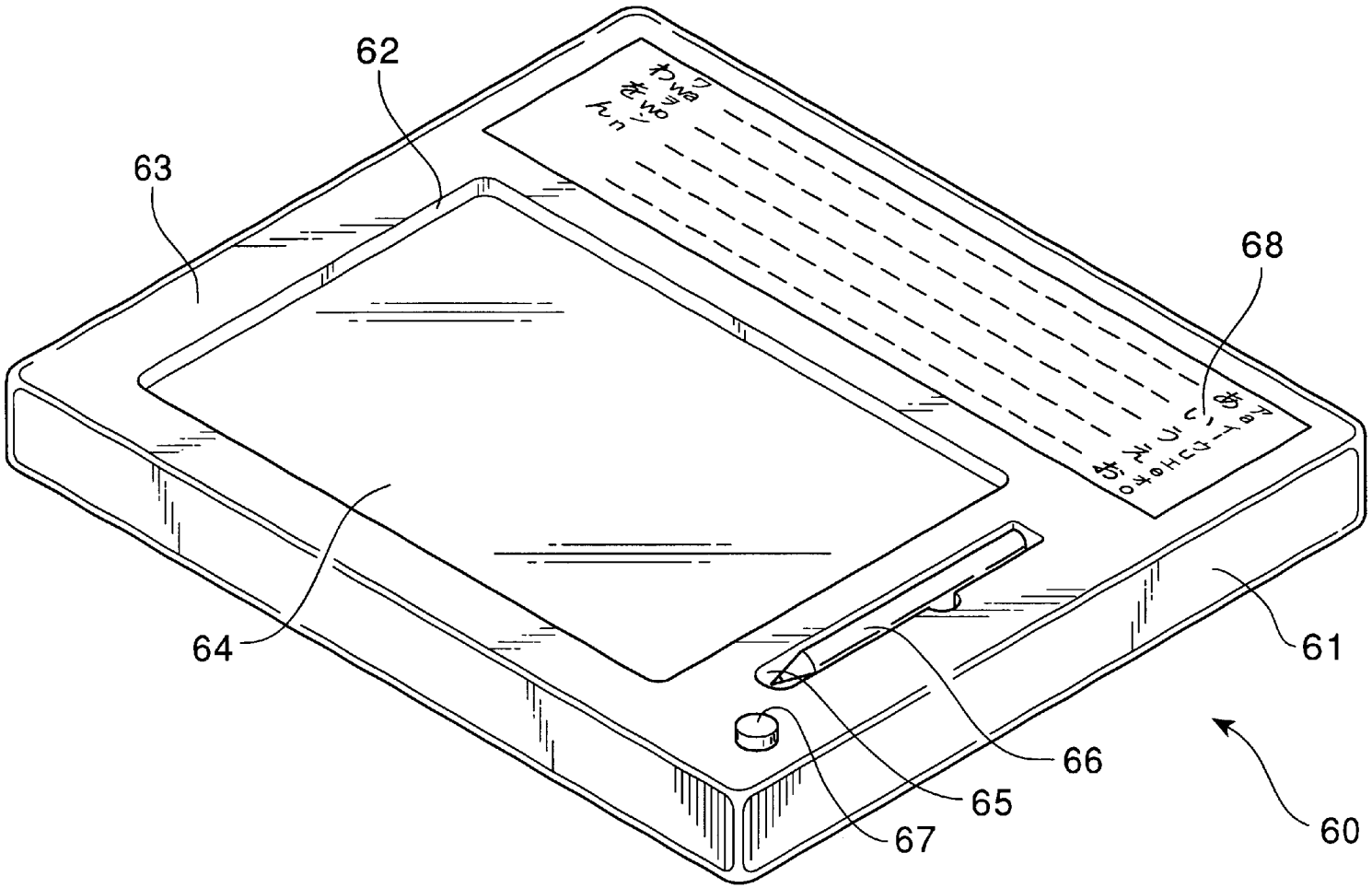
FIG. 6 is a perspective view showing an exterior of a first embodiment of a writing device for practice in writing characters according to the present invention.

FIG. 6 is a perspective view showing an exterior of a first embodiment of a writing device for practice in writing characters according to the present invention. A writing device 60 of the present embodiment is a magnetically writable and erasable writing device which includes an internal mechanism as described in the aforementioned Japanese Patent Application No. Hei 11-81877, and which is adapted to allow characters or figures written on a top face of a writing sheet 64 to be easily erased only by pressing down an erasing button 67 for a moment. As shown in FIG. 6, an exterior of the writing device 60 of the present embodiment comprises: a case member 61 provided with an opening 62 in a top surface of the case member wherein a frame section 63 surrounding the opening 62 is formed on the top surface of the case member; a writing sheet 64 which is comprised of a microcapsule magnetic sheet and which is disposed on the case member 61 so as to expose a top face of the writing sheet from the opening 62 of the case member. A depression 65 is formed on the right region of the frame section 63, and a magnetic pen 66 having an edge formed of a magnetic member is accommodated in the depression 65. An erasing button is provided on the right lower region of the frame section 63, and a seal indicating a correspondence sheet of hiragana, katakana, and alphabetical character as a character model 68 is affixed on the upper region of the frame section 63. Thus, immediately after picking up the writing device 60, learner can start practicing and writing characters on the writing sheet 64 with the magnetic pen 66 with reference to the character model 68 on the upper region of the frame section 63 without preparing a referential character model in addition to the writing device and without placing in it an appropriate position.

While the correspondence table of hiragana, katakana, and alphabetical character is indicated as a character model in the present embodiment, the character model may optionally be selected and may, for example, be a table only describing each order for writing hiragana or a table of alphabet.

Figure 7:
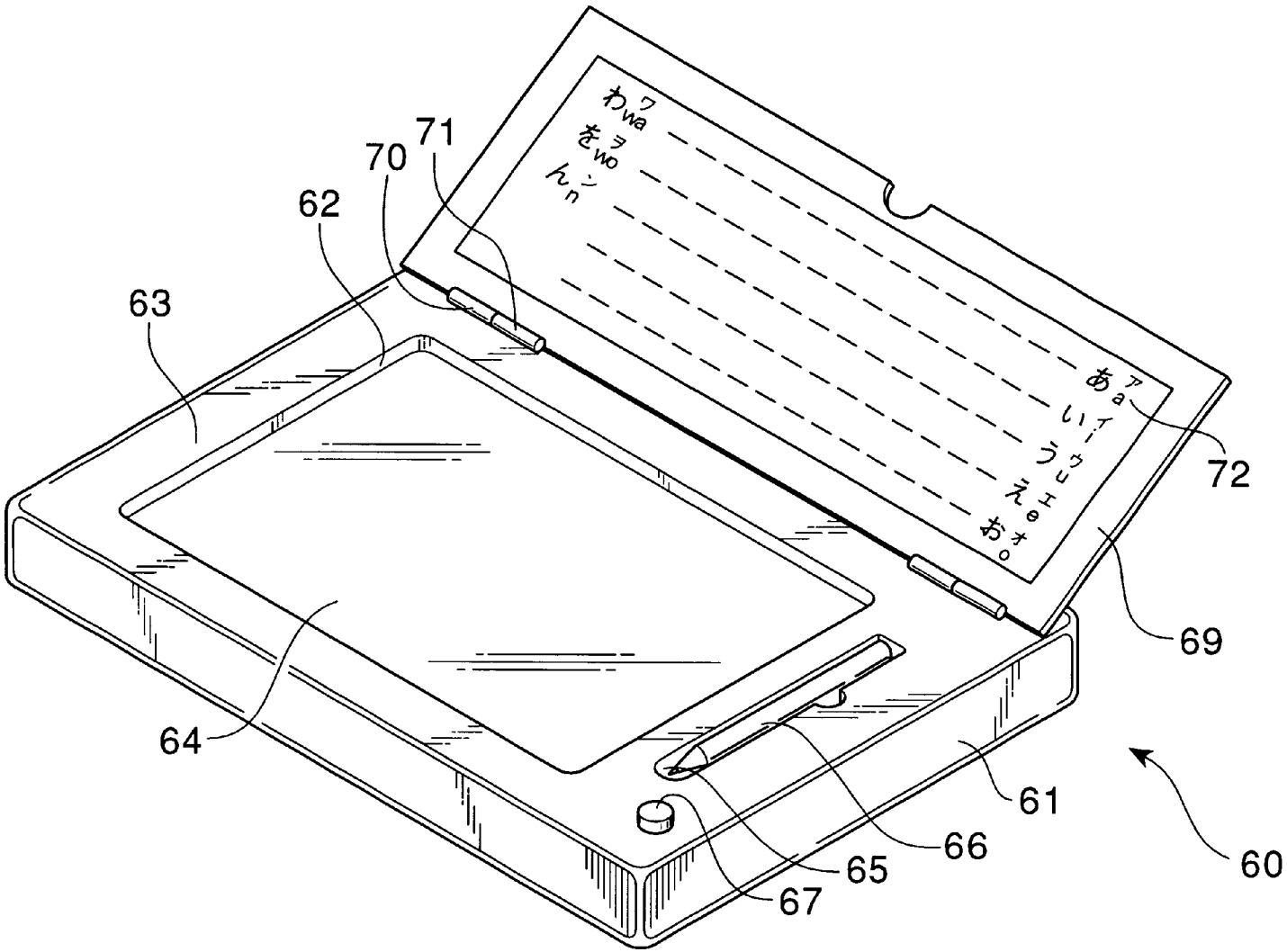
FIG. 7 is a perspective view showing an exterior of a second embodiment of a writing device for practice in writing characters according to the present invention.

FIG. 7 is a perspective view showing an exterior of a second embodiment of a writing device for practice in writing characters according to the present invention. The same subject as the first embodiment in FIG. 6 indicates the same reference number as FIG. 6. As the difference between the present embodiment and the first embodiment, a lid member covering all or part of the case member 61 is pivotally attached to the case member 61 by the engagement between a shaft-like protrusion 70 provided on one side of the lid member 69 and a support member 71 which has a groove receiving the protrusion 70 and which is provided on the upper edge region of the top surface of the case member 61. A character model 72 is indicated on a spread surface of the lid member 69.

Figure 8A:
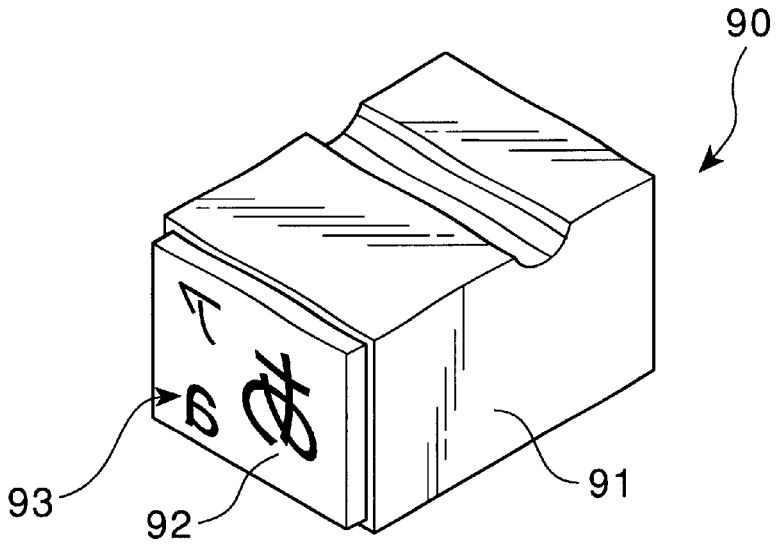
FIG. 8(*a*) is a perspective view showing a stamping face of a first embodiment of a character model stamp according to the present invention.
Figure 8B:
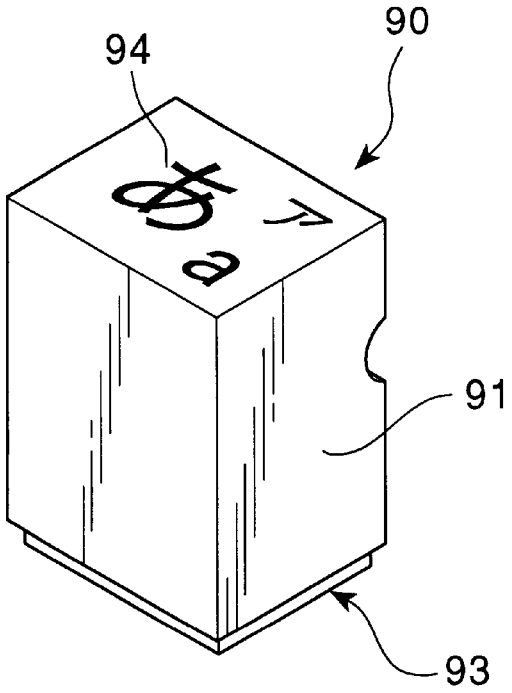

FIG. 8(*a*) is a perspective view showing a stamping face of a first embodiment of a character model stamp according to the present invention. FIG. 8(*b*) is a perspective view showing an upper surface of the first embodiment of the character model stamp. As shown in FIG. 8(*a*) and FIG. 8(*b*), the character model stamp 90 comprises a non-magnetic rectangular-parallelepiped gripping member 91 formed of plastic, and a stamping face which is formed by affixing a magnetic, planar magnet rubber 92, which has a mirror image shape of the character model, on a lower surface of the gripping member 91. Thus a learner can fairly easily depict the character model on the top face of the writing sheet by putting the stamping face 93 on the top face of the writing sheet as shown in FIG. 6 and FIG. 7. The stamping face 93 may be formed by spraying a paint of magnetic particles in the shape of a mirror image of the character model, a substitute for the magnet rubber 92. The mark of the character model may be indicated by a solid line or dotted line thinner than a line written by the magnetic pen, or an outline which traces a periphery of the character model. Thus, a learner can learn characters by tracing the character model indicated on the top face of the writing sheet, as same as the case of using the aforementioned character drill book. In the present embodiment, the character model depicted by the stamping face 93 is indicated on a top surface of the character model stamp 90. However, other kind of character model may be indicated. For example, when a katakana model corresponding to hiragana model which is to be depicted by the stamping face 93 is indicated on the top surface of the character model stamp 90, a learner firstly tries to figure out a hiragana model to be depicted by the stamping face corresponding to the katakana model which is indicated on the top surface of the character model stamp 90, and learner can then confirm the answer by pressing the character model stamp 90 on the top surface of the writing device, which enables to learn characters in various ways.

Figure 9:
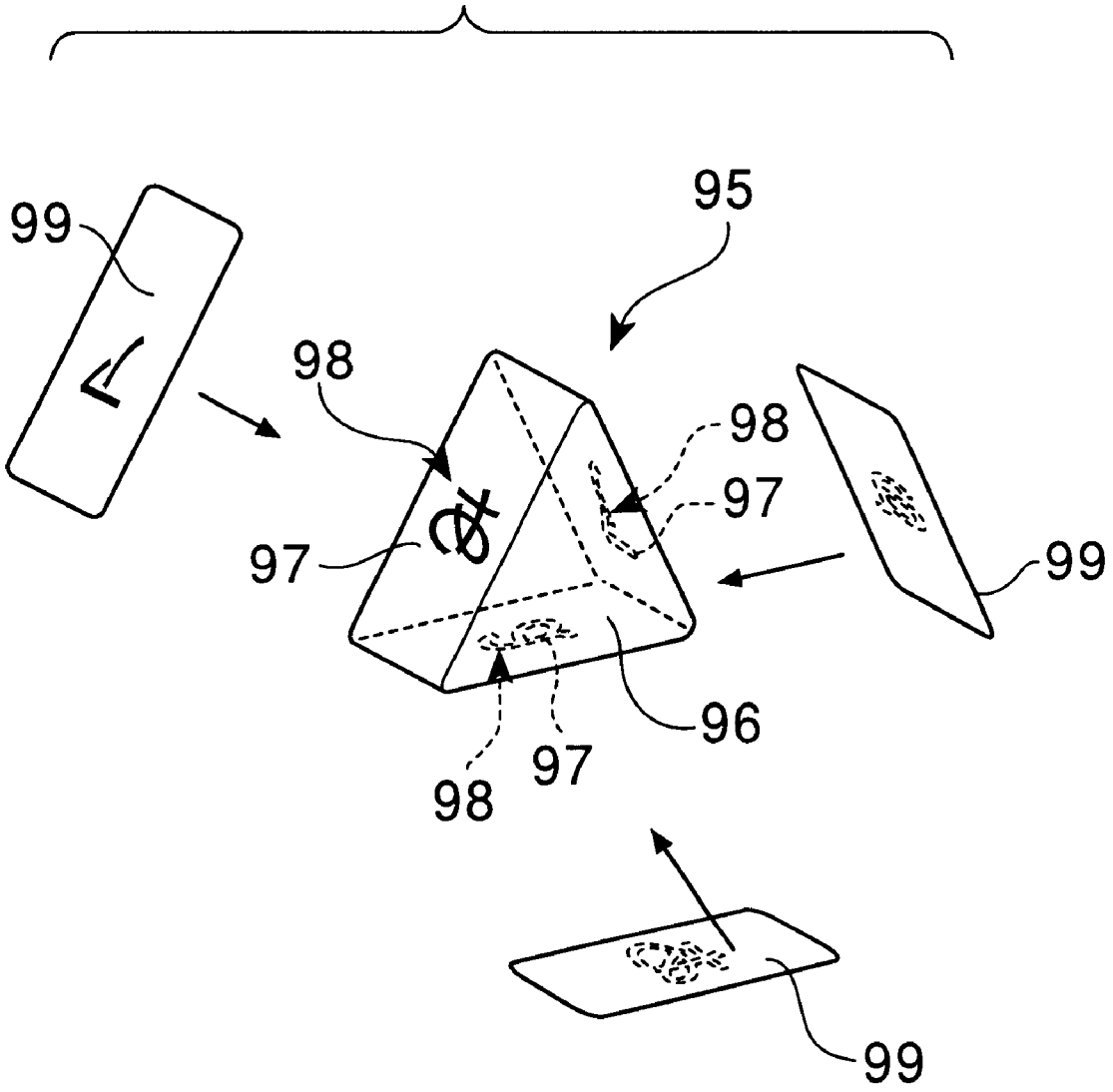
FIG. 9 is a perspective view showing a second embodiment of the character model stamp according to the present invention.

FIG. 9 is a perspective view showing a second embodiment of the character model stamp according to the present invention. As shown in FIG. 9, a gripping member 96 of a character model stamp 95 has equilateral triangular pole shape. On each of three side surfaces of the gripping member 96, a stamping face 98 indicating a mirror image 97 of the character model by a magnetic member. Thus, a learner can roll the character model stamp 95 to sequentially depict each character model by three stamping faces. That is, while the conventional ink stamp has only one stamping face, this character model stamp 95 has a plurality of stamping faces 98 so that the annoyance of storing can be removed due to relatively small space required. A depression may be respectively provided in the center region of two opposing equilateral triangle shaped surfaces of the gripping member 96 for easy gripping. A non-magnetic seal 99 indicating the character model which is to be depicted by the stamping face 98 put on the top face of the writing sheet may be affixed on the stamping face 98 which is to be faced to a learner when the stamping face 98 is put on the top face of the writing sheet in the particular direction, so that the predetermined direction and the character to be depicted can be indicated.

Thus, according to the writing device for practice in writing characters of the present invention, there is provided an improved writing device, in which no supplement of writing tools and the like is required, hands, clothes and the like being free from stain, the burden of preparing and handling of the referential character model being removed, no extra space being required, embarrass store keeping being removed, the character model being magnetically writable with extremely easy, the practice by tracing the dotted lines of the character model being able to be performed without enlarging the writing device and otherwise limiting the number of the characters.

What is claimed is:

1. A magnetically writable and erasable writing device for practice in writing characters, said writing device comprising:

a case member provided with an opening in a top surface of said case member wherein a frame section surrounding said opening is formed on said top surface of said case member; a writing sheet which is comprised of a microcapsule magnetic sheet and which is disposed on said case member so as to expose a top face of said writing sheet from said opening of said case member; a magnetic member for writing on said writing sheet; an erasing member which is positioned under said writing sheet and which has magnetism; and an actuating mechanism projecting from the case member for actuating said erasing member upon depression of the actuating mechanism, wherein putting said magnetic member on said top face of said writing sheet enables writing, moving said erasing member towards and away from a back face of said writing sheet enabling the written contents to be erased, said frame section of said top surface of said case member includes a character model to provide an example for practice in writing characters on the writing sheet.

2. A writing device for practice in writing characters as defined in claim 1, further including a lid member which covers all or part of said top surface of said case member and which is pivotally attached to said case member, wherein a spread surface of said lid member indicates the character model.

3. A writing device for practice in writing characters as defined in claim 1, wherein said character model is an alphabetical character.

4. A writing device for practice in writing characters as defined in claim 1, wherein said magnetic member comprise a non-magnetic gripping member, and a stamping face which includes a magnetic member indicating a mirror image of said character model on a surface of said gripping member, wherein putting said stamping face on said top face of said writing sheet enables a mark of said character model be indicated on said top face of said writing sheet.

5. A writing device for practice in writing characters as defined in claim 4, wherein said gripping member is a polyhedron, and two or more side surfaces of said polyhedron include said stamping face.

6. A writing device for practice in writing characters as defined in claim 1, wherein said mark of said character model is indicated by a solid line or dotted line thinner than a line written by a magnetic pen, or an outline which traces a periphery of said character model.

* * * * *